US007686896B2

(12) United States Patent
Yoshida et al.

(10) Patent No.: US 7,686,896 B2
(45) Date of Patent: Mar. 30, 2010

(54) HIGH-STRENGTH STEEL SHEET EXCELLENT IN DEEP DRAWING CHARACTERISTICS AND METHOD FOR PRODUCTION THEREOF

(75) Inventors: Hiromi Yoshida, Hiroshima (JP); Kaneharu Okuda, Chiba (JP); Toshiaki Urabe, Chiba (JP); Yoshihiro Hosoya, Chiba (JP)

(73) Assignee: JFE Steel Corporation (JP)

( * ) Notice: Subject to any disclaimer, the term of this patent is extended or adjusted under 35 U.S.C. 154(b) by 244 days.

(21) Appl. No.: 10/566,852

(22) PCT Filed: Sep. 17, 2004

(86) PCT No.: PCT/JP2004/014039

§ 371 (c)(1),
(2), (4) Date: Feb. 22, 2006

(87) PCT Pub. No.: WO2005/031022

PCT Pub. Date: Apr. 7, 2005

(65) Prior Publication Data

US 2006/0191612 A1 Aug. 31, 2006

(30) Foreign Application Priority Data

Sep. 26, 2003 (JP) ..... 2003-335731
Sep. 6, 2004 (JP) ..... 2004-258659

(51) Int. Cl.
*C22C 38/12* (2006.01)
*C22C 38/04* (2006.01)
*C21D 8/02* (2006.01)

(52) U.S. Cl. ..... 148/320; 148/332; 148/333; 148/335; 148/336; 148/603; 148/651; 148/652; 148/533

(58) Field of Classification Search ..... 148/320, 148/328, 332, 333–336, 603, 651, 652, 533
See application file for complete search history.

(56) References Cited

FOREIGN PATENT DOCUMENTS

| | | |
|---|---|---|
| EP | 1193322 A1 | 4/2002 |
| EP | 1367143 A1 | 12/2003 |
| JP | 55-10650 | 1/1980 |

(Continued)

OTHER PUBLICATIONS

Computer-generated English translation of Japanese patent 2002-226941, Sakata Takashi, Aug. 14, 2002.*

*Primary Examiner*—Deborah Yee
(74) *Attorney, Agent, or Firm*—DLA Piper LLP (US)

(57) ABSTRACT

A high-strength steel sheet is useful for applications to automobile steel sheets and the like and has excellent deep drawability, a tensile strength (TS) of as high as 440 MPa or more, and a high r value (average r value ≧1.2), and a process for producing the steel sheet. The steel sheet has a composition containing, by % by mass, 0.010 to 0.050% of C, 1.0% or less of Si, 1.0 to 3.0% of Mn, 0.005 to 0.1% of P, 0.01% or less of S, 0.005 to 0.5% of Al, 0.01% or less of N, and 0.01 to 0.3% of Nb, the Nb and C contents in steel satisfying the relation, (Nb/93)/(C/12)=0.2 to 0.7, and the balance substantially including Fe and inevitable impurities. The steel microstructure contains a ferrite phase and a martensite phase at area ratios of 50% or more and 1% or more, respectively, and the average r value is 1.2 or more.

19 Claims, 3 Drawing Sheets

FOREIGN PATENT DOCUMENTS

| | | | |
|---|---|---|---|
| JP | 55-100934 | | 7/1980 |
| JP | 56-139654 | A | 10/1981 |
| JP | 7054051 | A | 2/1995 |
| JP | 10-35900 | A | 2/1998 |
| JP | 10-121205 | A | 5/1998 |
| JP | 11343538 | A | 12/1999 |
| JP | 2000109966 | A | 4/2000 |
| JP | 2002-226941 | A | 8/2002 |
| JP | 2002226941 | A | 8/2002 |
| JP | 2002-256386 | A | 9/2002 |
| JP | 2003-64444 | A | 3/2003 |

* cited by examiner

HIGH-STRENGTH STEEL SHEET EXCELLENT IN DEEP DRAWING CHARACTERISTICS AND METHOD FOR PRODUCTION THEREOF

TECHNICAL FIELD

This disclosure provides a high-strength steel sheet useful for applications to automobile steel sheets and the like and having excellent deep drawability, a high tensile strength (TS) of 440 MPa or more, and a high r value (average r value ≧1.2), and also provides a process for producing the same.

BACKGROUND ART

From the viewpoint of global environment conservation, improvement in the fuel consumptions of automobiles has recently been required for satisfying the $CO_2$ emission regulations. In addition, in order to secure safe of passengers at the time of crash, improvement in the safety of motor vehicle bodies has been also required mainly in consideration of the crashworthiness of vehicle bodies. In this way, weight lightening and strengthening of vehicle bodies have been positively advanced.

In order to simultaneously achieve weight lightening and strengthening of vehicle bodies, it is said to be effective that a part material is strengthened and the thickness of a part of sheet is decreased within a range which causes no problem of rigidity, and the weight is decreased by decreasing the thickness of a sheet. Therefore, high-tensile strength steel sheets have been recently positively used for automobile parts.

The weight lightening effect increases as the strength of the steel sheet used increases, and thus the car industry has the tendency to use steel sheets having a tensile strength (TS) of 440 MPa or more, for example, as panel materials for inner parts and outer parts.

On the other hand, many automobile parts made of steel sheets are formed by press forming, and thus steel sheets for automobiles are required to have excellent press formability. However, high-strength steel sheets are greatly inferior in formability, particularly deep drawability, to general mild steel sheets. Therefore, steel sheets having high deep drawability and a TS of 440 MPa or more, more preferably a TS of 500 MPa or more, and further preferably a TS of 590 MPa or more have been increasingly required for advancing weight lightening of vehicles. Also, high-strength steel sheets having a high Lankford value (referred to as a "r value" hereinafter), which is an evaluation index for deep drawability, for example, average r value ≧1.2, have been required.

As means for increasing strength while maintaining a high r value, Ti and Nb are added in amounts sufficient to fix carbon and nitrogen dissolved in ultra low carbon steel to form IF (Interstitial atom free) steel to be used as a base, and solid-solution strengthening elements such as Si, Mn, P, and the like are added to the base. This method is disclosed in, for example, Japanese Unexamined Patent Application Publication No. 56-139654.

Japanese Unexamined Patent Application Publication No. 56-139654 discloses a technique for a high-strength cold rolled steel sheet having excellent formability, anti-aging properties, a tensile strength at the level of 35 to 45 kgf/mm$^2$ (level of 340 to 440 MPa), and the composition: C: 0.002 to 0.015%, Nb: C %×3 to C %×8+0.020%, Si: 1.2% or less, Mn: 0.04 to 0.8%, and P: 0.03 to 0.10%. Specifically, this document discloses that a anti-aging high-strength cold-rolled steel sheet having a TS of 46 kgf/mm$^2$ (450 MPa) and an average r value of 1.7 can be produced by hot rolling, cold rolling, and recrystallization annealing ultra low carbon steel used as a raw material and containing 0.008% of C, 0.54% of Si, 0.5% of Mn, 0.067% of P, and 0.043% of Nb.

However, it has been known that when a high-strength steel sheet having a tensile strength of 440 MPa or more or a higher tensile strength of 500 MPa or more or 590 MPa or more is produced by the technique of adding solid-solution strengthening elements to ultra low carbon steel used as a raw material, the amounts of the alloy elements added are increased to cause the problem of surface appearance, the problem of degrading plating performance, the problem of secondary cold-work embrittlement, and the like. Also, the addition of large amounts of solid-solution strengthening elements decreases the r value, thereby causing the problem that the r value level is decreased as strength is increased. Furthermore, in order to decrease a carbon content to the ultra low carbon region, such a C content of less than 0.010% as disclosed in the Japanese Unexamined Patent Application Publication No. 56-139654, vacuum degassing must be performed in a steel making process. This means that a large amount of $CO_2$ is generated in a production process. Therefore, from the viewpoint of global environment conservation, it is difficult to say that this technique is a preferable technique.

Besides the above-described solid-solution strengthening method, a microstructure strengthening method can be used as a method for increasing the strength of a steel sheet. For example, a dual phase steel sheet (DP steel sheet) having a soft ferrite phase and a hard martensite phase is produced by this method. A DP steel sheet generally has characteristics, such as substantially excellent ductility, an excellent strength-ductility balance (TS×E1), and a low yield ratio (YS/TS). In other words, the DP steel sheet has characteristics, such as a low yield ratio for the tensile strength and excellent shape fixability in press forming. However, the steel sheet has a low r value and unsatisfactory deep drawability. This is said to be due to the fact that dissolved C, which is essential in forming a martensite phase, inhibits the formation of a {111} recrystallized texture effective in increasing the r value.

For example, Japanese Examined Patent Application Publication No. 55-10650 or Japanese Unexamined Patent Application Publication No. 55-100934 discloses a technique as an attempt to improve the r value of such a dual-phase steel sheet Japanese Examined Patent Application Publication No. 55-10650 discloses a method including cold rolling, box annealing at a temperature of a discloses a method including cold rolling, box annealing at a temperature of a recrystallization temperature to an $Ac_3$ transformation point, heating to 700 to 800° C. for forming a dual phase, and then quenching and tempering. However, this method includes quenching and tempering in continuous annealing, and thus has the problem of production cost. Also, box annealing is inferior in treatment time and efficiency to continuous annealing.

The technique of Japanese Unexamined Patent Application Publication No. 55-100934 for achieving a high r value includes cold rolling, box annealing at a temperature in a ferrite (α)-austenite (γ) intercritical region, and then continuous annealing. In this technique, Mn is concentrated from a α phase to a γ phase in soaking for box annealing. Then, the Mn-concentrated phase is preferentially converted to the γ phase during continuous annealing, and thereby a mixed microstructure can be obtained by cooling even at a gas jet cooling rate. However, this method requires long-term box annealing at a relatively high temperature for concentrating Mn, and also requires a large number of steps. Therefore, the method has not only low economics from the viewpoint of production cost but also many problems with the production process, such as the adhesion of coiled steel sheets, the occurrence of a temper color, a decrease in life of a furnace inner cover, and the like.

Japanese Examined Patent Application Publication No. 1-35900 discloses a process for producing a dual-phase high-strength cold-rolled steel sheet having excellent deep drawability and shape fixability, in which steel containing 0.003 to 0.03% of C, 0.2 to 1% of Si, 0.3 to 1.5% of Mn, and 0.02 to 0.2% of Ti ((effective Ti/(C+N)) atomic concentration ratio of 0.4 to 0.8) is hot-rolled, cold-rolled, and then continuously annealed by heating to a predetermined temperature and then rapidly cooling. Specifically, the document discloses that steel having a composition including, % by mass, 0.012% of C, 0.32% of Si, 0.53% of Mn, 0.03% of P, and 0.051% of Ti is cold-rolled, heated to 870° C. in a α-γ intercritical region, and then cooled at an average cooling rate of 100° C./s to produce a dual-phase cold rolled steel sheet having a r value of 1.61 and a TS of 482 MPa. However, a water quenching apparatus is required for achieving a cooling rate of as high as 100° C./s, and a problem with surface treatment properties of a water-quenched steel sheet is actualized, thereby causing problems of production equipment and material quality.

Japanese Unexamined Patent Application Publication No. 2002-226941 discloses a technique for improving the r value of a dual-phase steel sheet by optimizing the V content in relation to the C content. In this technique, C contained in steel is precipitated as a V-based carbide to minimize the amount of dissolved C before recrystallization annealing, thereby achieving a high r value. Then, the steel is heated in the α-γ intercritical region to dissolve the V-based carbide and concentrate C in the γ phase, and then cooled to produce a martensite phase. The addition of V increases the cost because V is expensive, and VC precipitated in the hot-rolled sheet increases deformation resistance in cold rolling. Therefore, for example, in cold rolling with a reduction ratio of 70% as disclosed in an example, a load on a roll is increased to cause the problems with production, such as an increase in the danger of occurrence of a trouble and the possibility of decreasing productivity.

Furthermore, Japanese Unexamined Patent Application Publication No. 2003-64444 discloses a technique as a technique for a high-strength steel sheet having excellent deep drawability and a process for producing the same. This technique is aimed at producing a high-strength steel sheet having a predetermined C content, an average r value of 1.3 or more, and a microstructure containing at least one of bainite, martensite, and austenite in a total of 3% or more. The process for producing the steel sheet includes cold rolling with a reduction rate of 30 to 95%, annealing for forming Al and N clusters and precipitates to develop a texture and increase the r value, and then heat treatment for causing the texture to contain at least one of bainite, martensite, and austenite in a total of 3% or more. This method requires annealing for achieving a high r value after cold rolling and then heat treatment for obtaining the texture, and the annealing step basically includes box annealing and requires a long holding time of 1 hour or more, thereby causing the problem of low productivity of the process (processing time). Furthermore, the resultant texture has a relatively high second phase fraction, and thus it is difficult to stably secure an excellent strength-ductility balance.

The conventional method for increasing strength by solid-solution strengthening, which has been conventionally investigated, requires the addition of large amounts or excessive amounts of alloy elements for increasing the strength of a (mild) steel sheet having excellent deep drawability, and thus the method has problems with the cost and process and problems with improvement in the r value.

The method utilizing microstructure strengthening requires two times of annealing (heating) and high-speed cooling equipment, and thus has problems with the production process. Although the method utilizing VC is also disclosed, the addition of expensive V increases the cost, and the precipitation of VC increases deformation resistance in rolling, thereby causing difficulty of stable production.

Thus, it could be helpful to resolve the problems of the conventional methods and provide a high-strength steel sheet having a TS of 440 MPa or more, an average r value ≧1.2 and excellent deep drawability, and a production process therefor. It could also be helpful to provide a high-strength steel sheet having a high average r value of 1.2 or more and excellent deep drawability while maintaining high strength, such as TS ≧500 MPa or TS ≧590 MPa, and a production process therefor.

SUMMARY

We succeeded in producing a high-strength steel sheet having an average r value of 1.2 or more and excellent deep drawability by controlling the Nb content in relation to the C content within a C content range of 0.010 to 0.050% by mass without using special or excessive alloy elements and equipment, the steel sheet having a steel microstructure containing a ferrite phase and a martensite phase.

In other words, we provide:

(1) A high-strength steel sheet having excellent deep drawability, an average r value of 1.2 or more, and a composition containing, by % by mass:

C: 0.010to 0.050%;
Si: 1.0% or less;
Mn: 1.0 to 3.0%;
P: 0.005 to 0.1%;
S: 0.01% or less;
Al: 0.005 to 0.5%;
N: 0.01% or less;
Nb: 0.01 to 0.3%; and the balance substantially including Fe and inevitable impurities, the Nb and C contents in steel satisfying the relation, (Nb/93)/(C/12)=0.2 to 0.7 (wherein Nb and C represents the contents (% by mass) of the respective elements), and the steel microstructure containing a ferrite phase and a martensite phase at area ratios of 50% or more and 1% or more, respectively.

(2) The high-strength steel sheet having excellent deep drawability described above in (1), the steel sheet satisfying the following relation between the normalized X-ray integrated intensity ratios of (222) plane, (200) plane, (110) plane, and (310) plane parallel to the sheet plane at a ¼ thickness of the steel sheet:

$P_{(222)}/\{P_{(200)}+P_{(110)}+P_{(310)}\}\geqq 1.5$ (wherein $P_{(222)}$, $P_{(200)}$, $P_{(110)}$, and $P_{(310)}$ are the normalized X-ray integrated intensity ratios of the (222) plane, (200) plane, (110) plane, and (310) plane, respectively, parallel to the sheet plane at a ¼ thickness of the steel sheet).

(3) The high-strength steel sheet having excellent deep drawability described above in (1) or (2), the steel sheet further containing at least one of Mo, Cr, Cu, and Ni in a total of 0.5% by mass or less in addition to the above-described composition.

(4) The high-strength steel sheet having excellent deep drawability described above in (1), (2), or (3), the steel sheet further containing 0.1% by mass or less of Ti in addition to the above-described composition, the contents of Ti, S, and N satisfying the following relation:

(Ti/48)/{(S/32)+(N/14)}≦2.0 (wherein Ti, S, and N represent the contents (% by mass) of the respective elements).

(5) The high-strength steel sheet having excellent deep drawability described above in any one of (1) to (4), the steel having a plated layer on a surface thereof.

(6) A process for producing a high-strength steel sheet having excellent deep drawability, the process including a hot rolling step of finish-rolling a steel slab by hot rolling at a finisher delivery temperature of 800° C. or more and coiling the hot-rolled sheet at a coiling temperature of 400 to 720° C., a cold-rolling step of cold-rolling the hot-rolled sheet to form a cold-rolled sheet, and a cold-rolled sheet annealing step of annealing the cold-rolled sheet at an annealing temperature of 800 to 950° C. and then cooling the annealed sheet in a temperature range from the annealing temperature to 500° C. at an average cooling rate of 5° C./s or more, the steel slab having a composition containing, by % by mass:

C: 0.010 to 0.050%;
Si: 1.0% or less;
Mn: 1.0 to 3.0%;
P: 0.005 to 0.1%;
S: 0.01% or less;
Al: 0.005 to 0.5%;
N: 0.01% or less;
Nb: 0.01 to 0.3%; and the Nb and C contents in steel satisfying the relation, (Nb/93)/(C/12)=0.2 to 0.7 (wherein Nb and C represent the contents (% by mass) of the respective elements).

(7) A process for producing a high-strength steel sheet having excellent deep drawability includes a hot rolling step of hot-rolling a steel slab to form a hot-rolled sheet having an average crystal grain size of 8 μm or less, a cold-rolling step of cold-rolling the hot-rolled sheet to form a cold-rolled sheet, and a cold-rolled sheet annealing step of annealing the cold-rolled sheet at an annealing temperature of 800 to 950° C. and then cooling the annealed sheet in a temperature range from the annealing temperature to 500° C. at an average cooling rate of 5° C./s or more, the steel slab having a composition containing, by % by mass:

C: 0.010 to 0.050%;
Si: 1.0% or less;
Mn: 1.0 to 3.0%;
P: 0.005 to 0.1%;
S: 0.01% or less;
Al: 0.005 to 0.5%;
N: 0.01% or less;
Nb: 0.01 to 0.3%; and the Nb and C contents in steel satisfying the relation, (Nb/93)/(C/12)=0.2 to 0.7 (wherein Nb and C represent the contents (% by mass) of the respective elements).

(8) The process for producing the high-strength steel sheet having excellent deep drawability described above in (6) or (7), in which the steel slab further contains at least one of Mo, Cr, Cu, and Ni at a total of 0.5% by mass or less in addition to the above-described composition.

(9) The process for producing the high-strength steel sheet having excellent deep drawability described above in (6), (7), or (8), in which the steel slab further contains 0.1% by mass or less of Ti in addition to the above-described composition, the contents of Ti, S, and N in steel satisfying the following relation:

(Ti/48)/{(S/32)+(N/14)}≦2.0 (wherein Ti, S, and N represent the contents (% by mass) of the respective elements).

(10) The process for producing the high-strength steel sheet having excellent deep drawability described above in any one of (6) to (9), the process further including a plating step of forming a plated layer on a surface of the steel sheet after the cold-rolled sheet annealing step.

A texture suitable for deep drawability is developed under a condition in which unlike in conventional ultra low carbon IF steel, the amount of dissolved C adversely affecting deep drawability is not excessively decreased in a range of 0.010 to 0.050% by mass, leaving an amount of dissolved C necessary for forming a martensite phase, thereby securing an average r value of 1.2 or more and high drawability and forming a dual-phase microstructure of steel having a ferrite phase and a second phase including a martensite phase. As a result, a high strength TS of 440 MPa or more, preferably 500 MPa or more, and more preferably 590 MPa or more can be achieved.

Although the reason for this is not necessarily clear, a conceivable reason is as follows:

Conventional effective means for increasing the r value of a mild steel sheet by developing a {111} recrystallized texture is to minimize the amount of dissolved C before cold rolling and recrystallization or to make fine the microstructure of a hot-rolled sheet. On the other hand, the above-described DP steel sheet requires dissolved C for forming a martensite phase and thus has a low r value because a recrystallized texture as a main phase is not developed. However, we found that there is a very preferred component region capable of both developing a {111} recrystallized texture of a ferrite phase serving as a matrix phase and forming a martensite phase. In other words, it has been newly found that by controlling the C content to 0.010 to 0.050% by mass which is lower than that of a conventional DP steel sheet (low carbon steel level) and higher than that of ultra low carbon steel, and appropriately adding Nb according to the C content, development of a texture suitable for deep drawability, such as a {111} recrystallized texture, formation of a martensite phase can be both achieved.

As conventionally known, Nb has a retarding effect on recrystallization, and a hot-rolled sheet microstructure can be made fine by appropriately controlling the finishing temperature of hot rolling. Also, Nb contained in steel has the high ability of forming a carbide.

The hot-rolling finish temperature is controlled in an appropriate range directly above the $Ar_3$ transformation point to make fine the hot-rolled sheet microstructure, and the coiling temperature after hot rolling is also appropriately set to precipitate NbC in the hot-rolled sheet and decrease the amount of dissolved C before cold rolling and before recrystallization.

Furthermore, the Nb content and C content are set to satisfy the relation (Nb/93)/(C/12)=0.2 to 0.7, leaving C not precipitated as NbC.

It has been thought that the presence of such C inhibits the development of a {111} recrystallized texture. However, a higher r value can be achieved under a condition in which C is not completely precipitated and fixed as NbC, leaving dissolved C necessary for forming a martensite phase.

Although the reason for this is not clear, a conceivable reason is that the positive factor of the presence of solute C for refinement of the hot-rolled sheet microstructure is larger than the negative factor of the presence of solute C for the formation of a {111} recrystallized texture. The precipitation of NbC has not only the effect of precipitating and fixing solute C possibly inhibiting the formation of the {111} recrystallized texture but also the effect of suppressing the precipitation of cementite. In particular, coarse cementite on a grain boundary decreases the r value, but Nb possibly has the effect of inhibiting the precipitation of coarse cementite at a grain boundary because of the higher grain boundary diffusion rate than the transgranular diffusion rate. Furthermore, during cold rolling, a matrix is hardened due to the presence of the finely precipitated NbC within a grain (matrix), and thus strain is easily accumulated near a grain boundary relatively softer than the matrix. Therefore, the effect of accelerating the occurrence of a {111} recrystallized grain from a grain boundary is estimated. In particular, it is supposed that the effect of the precipitation of NbC in the matrix is exhibited within the appropriate C content range (0.010 to 0.050% by mass), not effective at the C content of conventional ultra low carbon steel. The technical idea is based on the finding of the appropriate C content range.

It is further supposed that C other than NbC is possibly present in the form of a cementite carbide or solute C. However, the presence of C not fixed as NbC permits the formation of a martensite phase during cooling in the annealing step, thereby succeeding in increasing strength.

According to the production process, a degassing step for making ultra low carbon steel in the steel making process is not required, and excessive alloy elements need not be added for utilizing solid-solution strengthening, as compared with conventional processes. Therefore, the production process is advantageous in cost. Furthermore, a special element which increases the alloy cost and rolling load, such as V, need not be added.

BRIEF DESCRIPTION OF THE DRAWINGS

FIG. 2(*b*) is an optical microphotograph of a hot-rolled sheet immersed in a nital solution to corrode the surface thereof in a comparative example not satisfying the proper range.

FIG. 3(*b*) is an optical microphotograph of a hot-rolled sheet immersed in a nital solution to corrode the surface thereof in an example satisfying the proper range.

DETAILED DESCRIPTION

Figure 1:
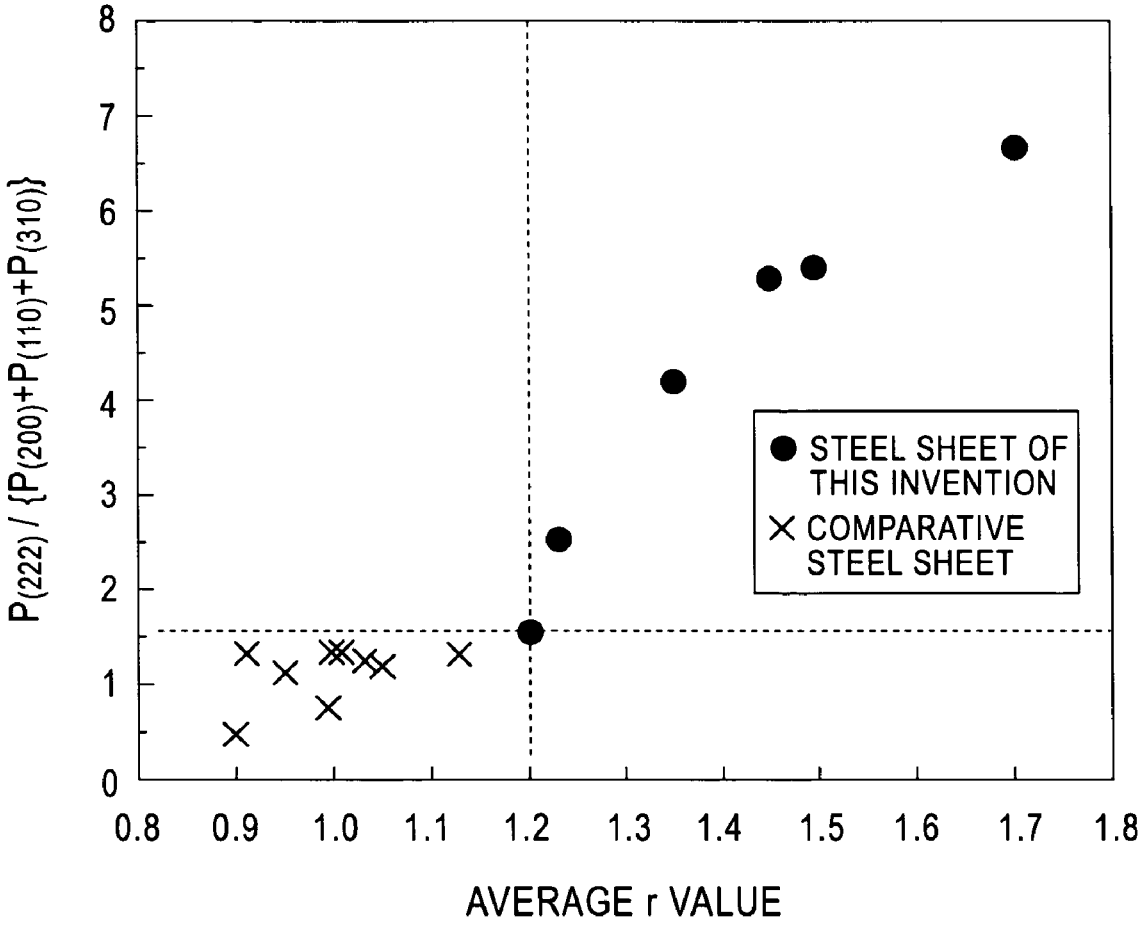
FIG. 1 is a graph which plots the calculated average r values and $P_{(222)}/\{P_{(200)}+P_{(110)}+P_{(310)}\}$ values of various steel sheets of the present invention and steel sheets of comparative examples.

The unit of the content of any element is "% by mass", but hereinafter the content is simply shown by "%" unless otherwise specified.

First the reasons for limiting the composition of a high-strength steel sheet will be described.

C: 0.010 to 0.050%

C is an important element together with Nb which will be described below. C is effective in increasing strength and promotes the formation of a dual phase containing a ferrite phase as a matrix phase and a second phase including a martenite phase. With a C content of less than 0.010%, the formation of the martensite phase becomes difficult. Therefore, 0.010% or more, preferably 0.015% or more, of C must be added from the viewpoint of formation of a dual-phase. In particular, in order to obtain a high strength TS of 500 MPa or more, of course, the strength can be adjusted using solid-solution strengthening elements, such as Si, Mn, P, and the like, in addition to the formation of a dual phase. However, from the viewpoint of making use of the characteristics of the steel sheet, which is a dual-phase steel sheet, the strength is most preferably adjusted by controlling the C content. In this case, the C content is preferably controlled to 0.020% or more, and in order to obtain a TS of 590 MPa or more, the C content is preferably controlled to 0.025% or more. Also, the C content preferably satisfies the relation to Nb, (Nb/93)/(C/12)=0.2 to 0.7, and more preferably the relation, (Nb/93)/(C/12)=0.2 to 0.5.

However, the C content exceeding 0.050% inhibits the development of a texture suitable for deep drawability as in conventional ultra low carbon steel, thereby failing to obtain a high r value. Therefore, the upper limit of the C content is 0.050%.

Si: 1.0% or Less

Si promotes ferrite transformation and increases the C content in untransformed austenite to facilitate the formation of a dual phase including a ferrite phase and a martensite phase, and also has a solid-solution strengthening effect. In order to obtain the effect, the Si content is preferably 0.01% or more and more preferably 0.05% or more. On the other hand, with the Si content of over 1.0%, a surface defect referred to as a "red scale" occurs in hot rolling, thereby degrading the surface appearance of the resulting steel sheet. Therefore, the Si content is 1.0% or less.

In hot dip galvanization (including alloying), Si degrades plating wettability to cause the occurrence of plating nonuniformity, thereby degrading plating quality. Therefore, in hot dip galvanizing, the Si content is preferably decreased to 0.7% or less.

Mn: 1.0 to 3.0%

Mn is effective in increasing strength and has the function to decrease the critical cooling rate with which a martensite phase can be obtained. Therefore, Mn accelerates the formation of a martensite phase during cooling after annealing, and thus the Mn content is preferably set according to the required strength level and the cooling rate after annealing. Mn is also an element effective in preventing hot brittleness due to S. From this viewpoint, 1.0% or more, preferably 1.2% or more, of Mn must be contained. Since the Mn content exceeding 3.0% degrades the r value and weldability, the upper limit of the Mn content is 3.0%.

P: 0.005 to 0.1%

P is an element effective in solid-solution strengthening. However, with a P content of less than 0.005%, not only this effect is not exhibited, but also the cost of dephosphorization in a steel making process is increased. Therefore, the P content is 0.005% or more and preferably 0.01% or more. On the other hand, an excessive P content of over 0.1% causes P segregation at a grain boundary and thus degrades secondary cold-work embrittlement and weldability. When a hot-dip galvanized steel sheet is produced, Fe diffusion from the steel sheet to a plated layer is suppressed at the interface between the plated layer and the steel sheet during alloying after hot-dip galvanization, thereby impairing alloying performance. Therefore, alloying must be performed at a high temperature, and plate peeling such as powdering, chipping, or the like easily occurs in the resulting plated layer. Thus, the upper limit of the P content is 0.1%.

S: 0.01% or Less

S is an impurity and causes hot brittleness, and is also present as an inclusion in steel and degrades the characteristics of a steel sheet. Therefore, the S content must be decreased as much as possible. Specifically, the S content is 0.01% or less because the S content up to 0.01% is allowable.

Al: 0.005 to 0.5%

Al is useful as a solid solution strengthening element and a deoxidization element for steel, and has the function to fix solute N present as an impurity to improve the anti-aging property. Furthermore, Al is useful as a ferrite forming element and a temperature control element for a α-γ intercritical region. In order to exhibit the function, the Al content must be 0.005% or more. On the other hand, the Al content exceeding 0.5% causes a high alloy cost and induces surface defects. Therefore, the upper limit of the Al content is 0.5% and preferably 0.1% or less.

N: 0.01% or Less

N is an element for degrading the anti-aging property, and thus the N content is decreased as much as possible. The anti-aging property degrades as the N content increases, and a large amount of Ti or Al must be added for fixing solute N. Therefore, the N content is preferably as low as possible, but the upper limit of the N content is 0.01% because the N content up to about 0.01% is allowable.

Nb: 0.01 to 0.3% and (Nb/93)/(C/12)=0.2 to 0.7

Nb is the most important element and has the function to make fine the microstructure of a hot-rolled sheet and precipitate and fix C as NbC in the hot-rolled sheet. Nb is also an element contributing to an increase in the r value. From this viewpoint, 0.01% or more of Nb must be contained. On the other hand, solute C is required for forming a martensite phase in a cooling step after annealing. The excessive Nb content exceeding 0.3% inhibits the formation of the martensite phase, and thus the upper limit of the Nb content is 0.3%.

In order to exhibit the effect of N, in particular, it is necessary that Nb and C are contained so that the Nb content (% by mass) and the C content (% by mass) satisfy the ratio of (Nb/93)/(C/12)=0.2 to 0.7 (wherein Nb and C represent the contents of the respective elements). The ratio of (Nb/93)/(C/12) represents the atomic concentration ratio of Nb to C. When (Nb/93)/(C/12) is less than 0.2, the hot-rolled sheet refining effect of Nb is decreased, and the amount of solute C is increased particularly within a high C content range, thereby inhibiting the formation of a recrystallized texture effective in increasing the r value. When (Nb/93)/(C/12) exceeds 0.7, the presence of C in an amount necessary for forming the martensite phase in steel is inhibited, thereby failing to finally obtain a microstructure having a second phase including the martensite phase.

Therefore, the Nb content is 0.01 to 0.3%, and Nb and C are contained so that the Nb and C contents satisfy the ratio of (Nb/93)/(C/12)=0.2 to 0.7 and more preferably (Nb/93)/(C/12)=0.2 to 0.5.

The basic composition of the high-strength steel sheet is as described above.

In addition to the above composition, at least one of Mo, Cr, Cu, and Ni, which will be described below, and/or Ti may be added.

At least one of Mo, Cr, Cu, and Ni: 0.5% or less in total

Like Mn, Mo, Cr, Cu, and Ni are elements having the function to decrease the critical cooling rate with which a martensite phase can be formed, and promoting the formation of a martensite phase in cooling after annealing, and also having an effect on improvement in the strength level. However, when at lease one of these elements is excessively added in a total of over 0.5%, the effect is saturated, and the cost is increased by the expensive element. The upper limit of the total of at least one of these elements is preferably 0.5%.

Ti: 0.1% or Less and Ti, S, and N Contents in Steel Satisfying (Ti/48)/{(S/32)+(N/14)}≦2.0

Ti is an element having an effect on precipitation and fixing of solute N, which is equivalent to or larger than that of Al. In order to obtain this effect, the Ti content is preferably 0.005% or more. However, when over 0.1% of Ti is excessively added, the cost is increased, and the presence of solute C necessary for forming the martensite phase in steel is inhibited by the formation of TiC. Therefore, the Ti content is preferably 0.1% or less.

Furthermore, Ti preferentially bonds to S and N and next bonds to C. In view of a decrease in yield of Ti due to the formation of an inclusion in steel or the like, when Ti is added so that (Ti/48)/{(S/32)+(N/14)} exceeds 2.0, the effect of Ti addition on fixing of S and N is saturated to rather promote the formation of TiC and increase the problem of inhibiting the presence of solute C in steel. Therefore, the Ti content preferably satisfies (Ti/48)/{(S/32)+(N/14)}≦2.0 which is a relation to the contents of S and N preferentially bonding to Ti in steel. In the relation, Ti, S, and N represent the contents (% by mass) of the respective elements.

The balance, excluding the above-descried components, preferably substantially includes iron and inevitable impurities.

Even when B, Ca, REM, or the like is added within an ordinary composition range of steel, no problem occurs. For example, B is an element having the function to improve the quenching hardenability of steel and can be added as occasion demands. However, when the B content exceeds 0.003%, the effect is saturated. Therefore, the B content is preferably 0.003% or less.

Ca and REM have the function to control the form of a sulfide inclusion and thus prevent deterioration in characteristics of a steel sheet. When the total content of at least one selected from Ca and REM exceeds 0.01%, the effect tends to be saturated. Therefore, the total content is preferably 0.01% or less.

Examples of the other inevitable impurities include Sb, Sn, Zn, Co, and the like. The allowable content ranges of Sb, Sn, Zn, Co are 0.01% or less, 0.1% or less, 0.01% or less, and 0.1% or less, respectively.

In addition to the above-described steel composition, the high-strength steel sheet must have a microstructure of steel including a ferrite phase and a martensite phase at area fractions of 50% or more and 1% or more, respectively, and an average r value of 1.2 or more.

(1) Having a microstructure of steel including a ferrite phase and a martensite phase at area fractions of 50% or more and 1% or more, respectively.

In order that the high-strength steel sheet has high deep drawability and a tensile strength TS of 440 MPa or more, the steel sheet must be a steel sheet having a microstructure of steel including a ferrite phase and a martensite phase at area fractions of 50% or more and 1% or more, respectively, i.e., a dual-phase steel sheet. In particular, the ferrite phase contained at an area fraction of 50% or more has a microstructure in which a texture suitable for deep drawability is developed, and thus the average r value of 1.2 or more can be achieved. When the area fraction of the ferrite phase is decreased to less than 50%, satisfactory deep drawability is difficult to secure, and thus the press formability tends to decrease. The area fraction of the ferrite phase is preferably 70% or more. In order to utilize the advantage of the dual phase, the area fraction of the ferrite phase is preferably 99% or less.

The ferrite phase includes a polygonal ferrite phase and a bainitic ferrite phase transformed from an austenite phase and having a high dislocation density.

It is necessary that the martensite phase is present, and the area fraction of the martensite phase is 1% or more. When the area fraction of the martensite phase is less than 1%, it is difficult to secure TS ≧440 MPa and thus difficult to achieve a satisfactory strength-ductility balance. The area fraction of the martensite phase is preferably 3% or more.

Besides the ferrite phase and the martensite phase, the microstructure may further contain a pearlite phase, a bainite phase, or a residual austenite (γ) phase. In order to sufficiently obtain the effects of the ferrite phase and the martensite phase, the total area fraction of the ferrite phase and the martensite phase is preferably 80% or more.

(2) Average r Value: 1.2 or More

The high-strength steel sheet satisfies the above-described composition and microstructure of steel and an average r value of 1.2 or more.

The average r value represents the average plastic strain ratio determined according to JIS Z 2254 and is calculated according to the following equation:

$$\text{Average } r \text{ value}=(r_0+2r_{45}+r_{90})/4$$

wherein $r_0$, $r_{45}$, and $r_{90}$ denote the measured plastic strain ratios of specimens sampled in directions at 0°, 45°, and 90°, respectively, with the rolling direction of the sheet plane.

The high-strength steel sheet preferably satisfies the above-described composition, microstructure of steel, and characteristics, and also the texture thereof preferably satisfies $P_{(222)}/\{P_{(200)}+P_{(110)}+P_{(310)}\}\geqq 1.5$ and more preferably $P_{(222)}/\{P_{(200)}+P_{(110)}+P_{(310)}\}\geqq 2.0$ wherein $P_{(222)}$, $P_{(200)}$, $P_{(110)}$, and $P_{(310)}$ are the normalized X-ray integrated intensity ratios determined by X-ray diffraction for the (222) plane, (200) plane, (110) plane, and (310) plane, respectively, parallel to the sheet plane at a ¼ thickness of the steel sheet.

FIG. 1 is a graph which plots the calculated r values and $P_{(222)}/\{P_{(200)}+P_{(110)}+P_{(310)}\}$ values of various steel sheets and steel sheets of comparative examples.

It is conventionally known that when a steel sheet has a {111} texture parallel to the sheet plane, the r value is high, but a {110} or {100} texture parallel to the sheet plane decreases a r value of steel.

As a result of intensive research on a correlation between the r value and texture of the steel sheet, it has been found that like the {100} and {110} planes, a (310) plane texture decreases the r value to a low extent, and thus a decrease in the (310) plane contributes to an increase in the r value, but details have not been clear. Although details are not clear, it is thought that an increase in the reduction ratio of hot rolling in an unrecrystallized γ region due to addition of Nb, the precipitation of fine NbC, and the presence of C not precipitated and fixed as NbC contribute to a decrease in the (310) plane.

The {111} texture represents that the <111> crystal direction is oriented in the direction perpendicular to the sheet plane. From the viewpoint of crystallography and the Bragg reflection conditions, in α-Fe having a body centered cubic structure, (111) plane diffraction occurs at a (222) plane, not at the (111) plane, and thus ($P_{222}$) of the (222) plane is used as the normalized X-ray integrated intensity ratio of the (111) plane. Since the [222] direction of the (222) plane is oriented in the direction perpendicular to the sheet plane, the <222> direction is substantially the same as the <111> direction. Therefore, a high intensity ratio of the (222) plane corresponds to the development of the {111} texture. Similarly, ($P_{200}$) of a (200) plane is used as the normalized X-ray integrated intensity ratio of the (100) plane.

The term "normalized X-ray integrated intensity ratio" means the relative intensity based on the normalized X-ray integrated intensity of a nonoriented standard sample (random sample). X-ray diffraction may be either an angular diffusion type or an energy dispersion type, and the X-ray source used may be either characteristic X-rays or white X-rays. The measurement planes preferably include 7 to 10 planes of (110) to (420) which are principal diffracting planes of α-Fe. Specifically, the position at a ¼ thickness of the steel sheet indicates a range of ⅛ to ⅜ of the thickness from the surface of the steel sheet, and X-ray diffraction may be performed on any plane within this range.

The high-strength steel sheet may be a cold-rolled steel sheet or a steel sheet having a plated layer formed by surface treatment such as electroplating or hot-dip galvanization or galvannealed layer, i.e., a plated steel sheet. Examples of the plated layer include plated layers conventionally formed on steel sheet surfaces, such as plated layers formed by pure zinc plating, zinc alloy plating using alloy elements including zinc as a main component, pure Al plating, and Al alloy plating using alloy elements including Al as a main component.

Next, the preferred process for producing the high-strength steel sheet will be described.

Since the composition of a steel slab used in the production process is the same as the composition of the above-described steel sheet, the description of the reasons for limiting the steel slab is omitted.

The high-strength steel sheet can be produced by a hot rolling step of hot-rolling the steel slab used as a raw material and having a composition within the above-described ranges to form a hot-rolled sheet, a cold-rolling step of cold-rolling the hot-rolled sheet to form a cold-rolled sheet, and a cold-rolled sheet annealing step of recrystallizing the cold-rolled sheet and forming a dual phase.

First, the steel slab is finish-rolled by hot rolling at a finisher delivery temperature of 800° C. or more, and then coiled at a coiling temperature of 400 to 720° C. to form a hot-rolled sheet (hot rolling step).

The steel slab used in the process is preferably produced by a continuous casting method, for preventing micro segregation of the components. However, the steel slab may be produced by an ingot-making method or a thin slab casting method. After the steel slab is produced, the steel slab is cooled to room temperature, and then again heated according to a conventional process. However, an energy saving process including hot direct rolling or direct hot charge rolling may be used without any problem, in which the hot steel slab delivered casting machine is rolled directly at the hot strip mill, or the hot steel slab is charged in a heating furnace without being cooled at room temperature and then after slight heat retaining hot-rolled.

The heating temperature of the slab is preferably as low as possible because the {111} recrystallized texture is developed by coarsening the precipitates to improve deep drawability. However, with the heating temperature of less than 1000° C., the rolling load is increased to increase the probability of causing a trouble in hot rolling. Therefore, the heating temperature of the slab is preferably 1000° C. or more. From the viewpoint of an increase in scale loss accompanying an increase in oxide weight, the upper limit of the slab heating temperature is preferably 1300° C.

The steel slab heated under the above-described conditions is hot-rolled by rough rolling and finish rolling. The steel slab is roughly rolled to form a bar. The conditions of rough rolling are not particularly specified, and rough rolling may be performed according to an ordinary method. From the viewpoint of decreasing the slab heating temperature and preventing a trouble in hot rolling, preferably, a so-called bar heater is practically used for heating the bar.

Next, the bar is finish-rolled to form the hot-rolled sheet. In this step, the finisher delivery temperature (FT) is 800° C. or more. This is aimed at obtaining a fine hot-rolled sheet microstructure capable of achieving excellent deep drawability after cold rolling and annealing. When FT is less than 800° C., the load of hot rolling is increased, and a processing recovery (ferrite grains) microstructure easily remains in the hot-rolled sheet microstructure, thereby inhibiting the development of the {111} texture after cold rolling and annealing. Therefore, the FT is 800° C. or more. When the FT exceeds 980° C., the microstructure is coarsened to cause the tendency to inhibit the formation and development of the {111} recrystallized texture after cold rolling and annealing. Therefore, in order to achieve a high r value, the upper limit of the FT is preferably 980° C. More preferably, the reduction rate in an unrecrystallized γ region directly above the $Ar_3$ transformation point is increased as much as possible, and thereby a texture suitable for increasing the r value can be formed after cold rolling and annealing.

In order to decrease the rolling load in hot rolling, lubricating rolling may be performed in a portion or over the entire path of finish rolling. The lubrication rolling is effective from the viewpoint of the uniform steel sheet shape and homogenization of the material property. The coefficient of friction of the lubrication rolling is preferably in a range of 0.10 to 0.25. A continuous rolling process is also preferred, in which adjacent bars are joined together and continuously finish-rolled. The continuous rolling process is preferred in view of the operational stability of hot rolling.

The coiling temperature (CT) is in a range of 400 to 720° C. This temperature range is a proper temperature range for precipitating NbC in the hot-rolled sheet. When the CT exceeds 720° C., crystal grains are coarsened to decrease the strength and inhibit an increase in the r value after cold rolled sheet annealing. When the CT is lower than 400° C., the precipitation of NbC little takes place to cause difficulty in increasing the r value. The CT is preferably 550° C. to 680° C.

The above-described hot-rolling step is capable of producing the hot-rolled steel sheet having an average crystal grain size of 8 μm or less. Namely, the high-strength steel sheet can be produced by a cold rolling step of cold-rolling the hot-rolled sheet used as a raw material and having a composition in the above-described ranges and an average crystal grain size of 8 μm or less, and a cold-rolled sheet annealing step of recrystallizing the cold-rolled sheet and forming the dual phase.

Microstructure of the Hot-Rolled Sheet: Average Crystal Grain Size of 8 μm or Less It is conventionally known for mild steel that the effect of increasing the r value increases as the crystal grain size of a hot-rolled sheet decreases.

Figure 2A:
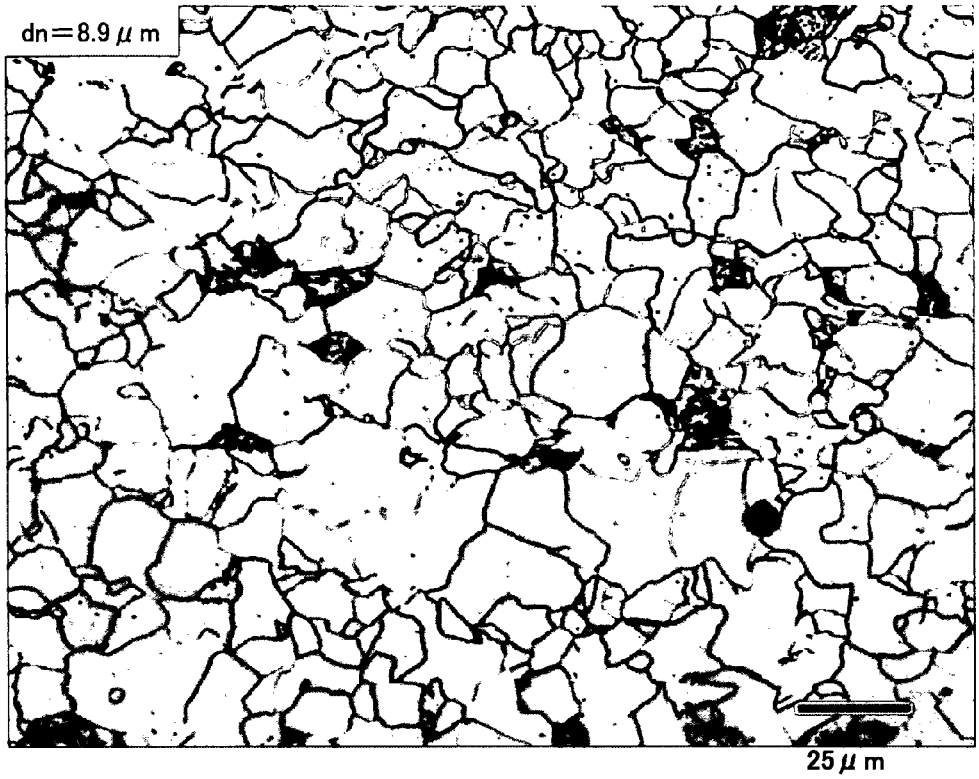
FIG. 2(*a*) is an optical microphotograph of a hot-rolled sheet immersed in a nital solution to corrode the surface thereof in a comparative example not satisfying the proper range.
Figure 2B:
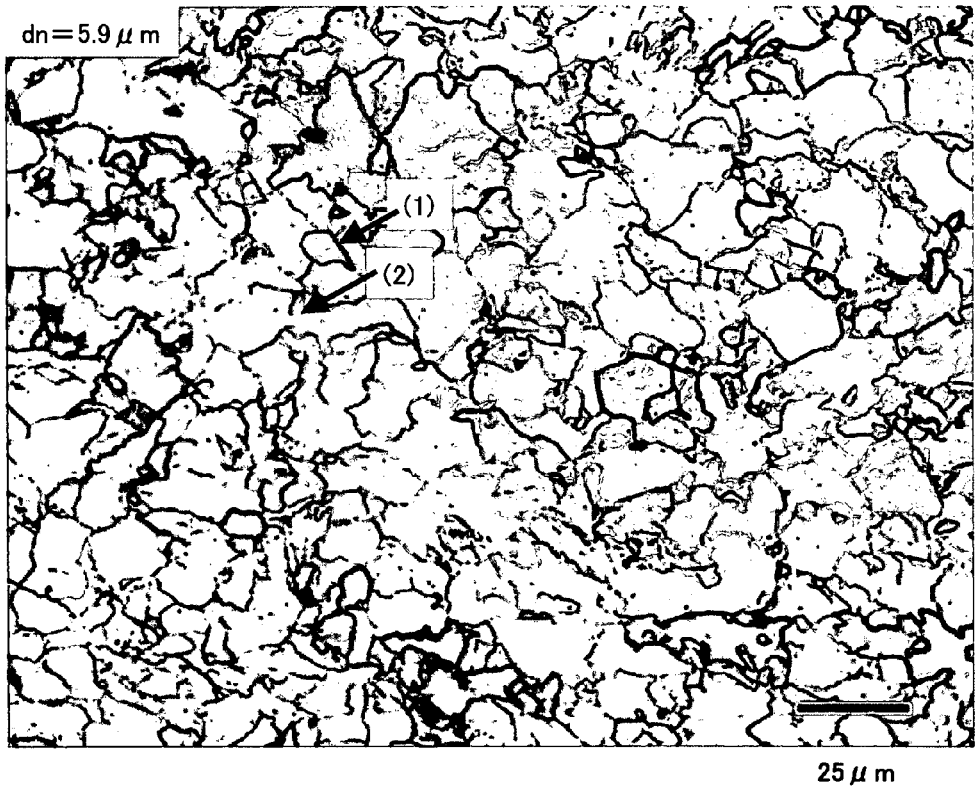

FIGS. 2(*a*), 2(*b*), 3(*a*), and 3(*b*) are optical microphotographs of respective hot-rolled steel sheets corroded with a nital solution. The nital solution used was a 3% nitric acid-alcohol solution (3% $HNO_3$—$C_2H_5OH$), and corrosion was performed for 10 to 15 seconds.

Figure 3:
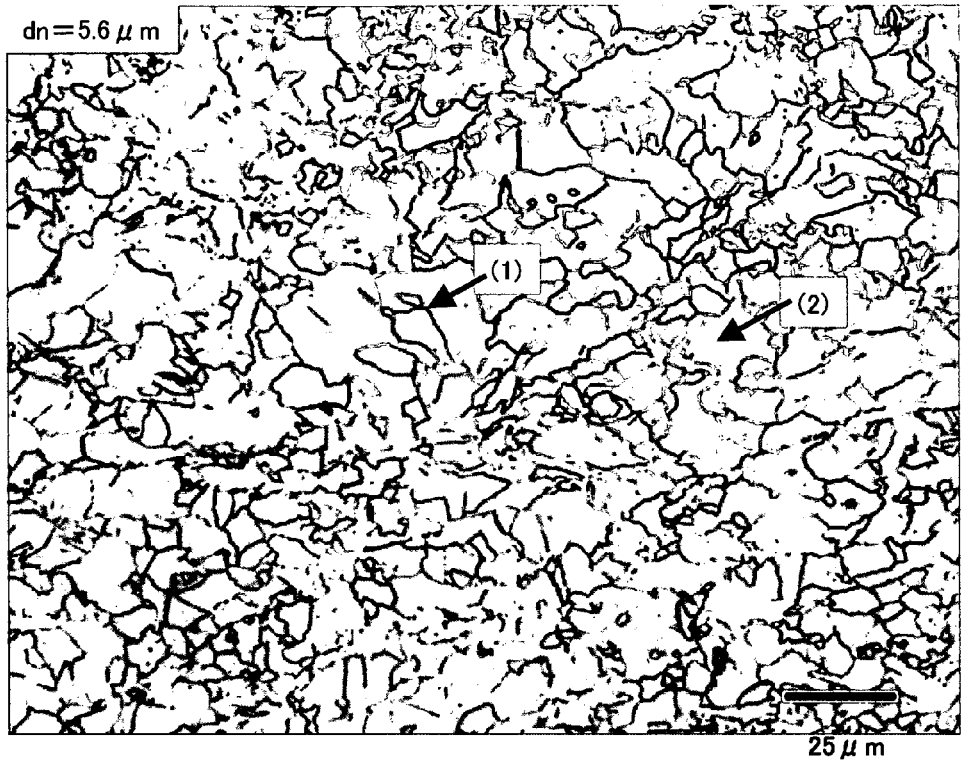
FIG. 3(*a*) is an optical microphotograph of a hot-rolled sheet immersed in a nital solution to corrode the surface thereof in an example satisfying the proper range.
Figure 3:
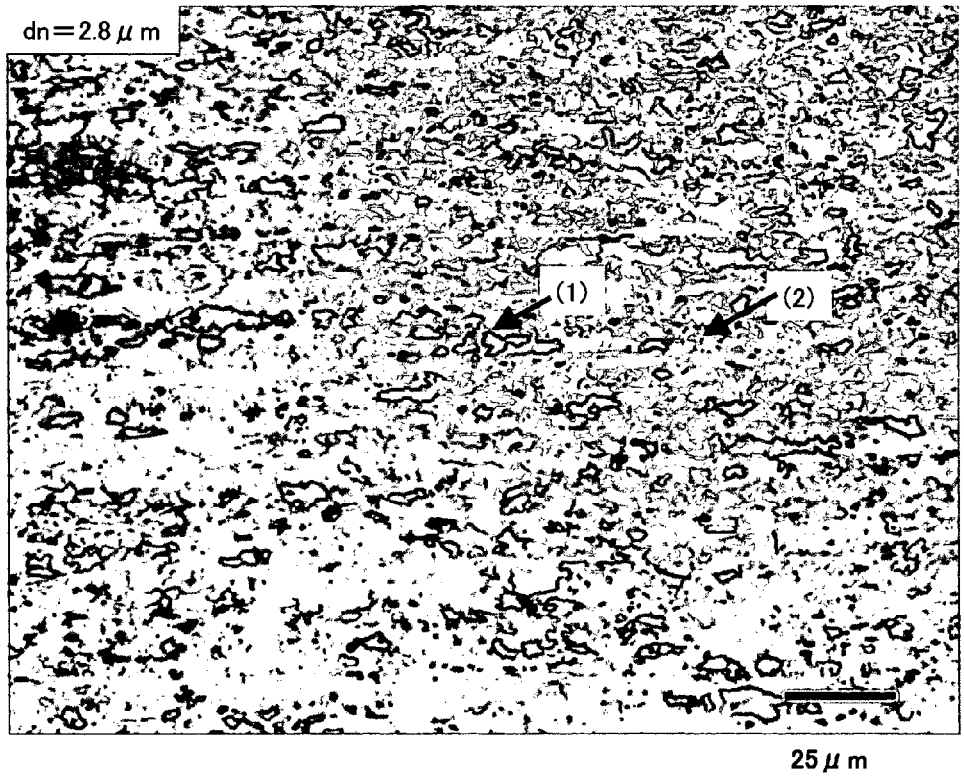

FIG. 2(*a*) is the microphotograph of the hot-rolled sheet containing 0.033% of C and no Nb and having an average crystal grain size of 8.9 μm, a steel sheet produced by cold rolling and annealing the hot-rolled sheet having an average r value of 0.9. FIG. 2(*b*) is the microphotograph of the hot-rolled sheet containing 0.035% of C and 0.015% of Nb ((Nb/93)/(C/12)=0.06) and having an average crystal grain size of 5.9 μm, a steel sheet produced by cold rolling and annealing the hot-rolled sheet having an average r value of 1.0. FIG. 3(*a*) is the microphotograph of the hot-rolled sheet containing 0.035% of C and 0.083% of Nb ((Nb/93)/(C/12)=0.31) and having an average crystal grain size of 5.6 μm, a steel sheet produced by cold rolling and annealing the hot-rolled sheet having an average r value of 1.3. FIG. 3(*b*) is the microphotograph of the hot-rolled sheet containing 0.035% of C and 0.072% of Nb ((Nb/93)/(C/12)=0.27) and having an average crystal grain size of 2.8 μm, a steel sheet produced by cold rolling and annealing the hot-rolled sheet having an average r value of 1.5. FIGS. 3(*a*) and 3(*b*) show the hot-rolled steel sheets having compositions. Details of the production conditions and the like are shown in Tables 1 and 2 below.

FIG. 2(*a*) shows the hot-rolled steel sheet not containing Nb out of the composition range of steel and having an average crystal grain size of 8 μm or more, thereby showing a low r value. FIG. 2(*b*) shows the hot-rolled steel sheet containing Nb and thus having a fine microstructure, and also having a Nb/C ratio out of the range, thereby exhibiting no effect and showing a low r value. FIGS. 3(*a*) and 3(*b*) show the steel sheets having a fine microstructure, thereby showing a higher r value.

When a hot-rolled steel sheet containing Nb is corroded with a nital solution, a normal deep corrosion line (1) and a shallow corrosion line (2) occur as grain boundaries.

A crystal grain size was measured using the lines (1) and (2) as grain boundaries.

With respect to the crystal grain size, a grain boundary with an inclination of 15° or more is often referred to as a "large angle grain boundary", and a grain boundary with an inclination of less than 15° is often referred to as a "small angle grain boundary". The EBSP (Electron Back Scatter Diffraction Pattern) analysis of the shallow corrosion line (2) showed that the shallow corrosion line (2) was a small angle grain boundary with an inclination of less than 15°. The hot-rolled steel sheet is characterized by the presence of many small angle grain boundaries with an inclination of less than 15°, i.e., many lines (2). As a result of measurement of the grain size using both the lines (1) and (2) as grain boundaries, it was found that with an average crystal grain size of over 8 μm, the effect of increasing the r value of the high-strength steel sheet is not exhibited, while with an average crystal grain size of as small as 8 μm or less, the average r value is 1.2 or more, and the effect of increasing the r value is exhibited. Therefore, the average crystal grain size of the hot-rolled sheet is preferably 8 μm or less.

As a result of EBSP analysis of the microstructure of steel, it was confirmed that measurement of a crystal grain size using the lines (1) and (2) as grain boundaries corresponds to measurement of a grain size assuming that crystal grain boundaries with an inclination of 5° or more are grain boundaries.

Although details are not clear, therefore, it is supposed that an inclination of 5° or more is effective in promoting the occurrence of a recrystallization nucleus suitable for deep drawability from a grain boundary.

As the method for measuring a crystal grain size, a microscopic structure of a sheet section parallel to the rolling direction is imaged with an optical microscope, the average section length 1 (μm) of crystal grains in a sample is determined by a cutting method according to JIS G 0552 or ASTM, and the average crystal grain size is determined by (ASTM) nominal grain size $d_n$=1.13×1. The crystal grain size may be measured using an apparatus of EBSP or the like.

The average section length for the average grain size was determined by imaging a microscopic structure of a sheet section parallel to the rolling direction with an optical microscope and a cutting method according to JIS G 0552. Namely, the number of the ferrite crystal grains which were cut with a predetermined segment length in the rolling direction and the direction perpendicular to the rolling direction according to JIS G 0552 was measured, the segment length was divided by the number of the ferrite crystal grains cut with the segment length to determine a section length in each direction, and an average (arithmetic mean) of the section lengths was calculated as the average section length 1 (μm) of the crystal grains.

Furthermore, in the steel, 15% or more of the total C content is preferably precipitated and fixed as NbC in the hot rolling step. In other words, in the hot rolling step, the ratio of C precipitated and fixed as NbC in steel is preferably 15% or more relative to the total C content.

The ratio of C precipitated and fixed as NbC in steel relative to the total C content (simply referred to as the "ratio of precipitated and fixed C" hereinafter) is the value obtained from the amount of precipitated Nb, which is determined by chemical analysis (extraction analysis) of the hot-rolled sheet, according to the following equation:

$$[C]_{fix}=100\times12\times([Nb^*]/93)/[C]_{total}$$

When steel does not contain Ti, Nb forms NbN, and thus [Nb*] is the following:

$$[Nb^*]=[Nb]-(93[N]/14),\ [Nb^*]>0$$

When steel contains Ti, N preferentially forms TiN, and thus [Nb*] is the following:

$$[Nb^*]=[Nb]-(93[N^*]/14)$$

In these equations, $$[N^*]=[N]-(14[Ti^*]/48),\ [N^*]>0$$

$$[Ti^*]=[Ti]-(48[S]/32),\ [Ti^*]>0$$

$[C]_{fix}$: ratio of precipitated and fixed C (%)

$[C]_{total}$: total C content of steel (% by mass)

[Nb], [N], [Ti], and [S] represent the amounts (% by mass) of precipitated Nb, precipitated N, precipitated Ti, and precipitated S, respectively.

As described above, in order to increase the r value, it is effective to decrease the amount of solute C before cold rolling and recrystallization, and the presence of precipitated NbC promotes an increase in the r value. When the content of precipitated and fixed C is 15% or more relative to the total C content in steel, the effect is exhibited. When the upper limit of the ratio of precipitated and fixed C relative to the total C content satisfies the condition that the Nb content is less than the upper limit of the proper Nb range, (Nb/93)/(C/12)=0.7, a higher r value and the formation of the martensite phase after annealing are both satisfied without any problem.

Next, the hot-rolled sheet is cold-rolled to form the cold-rolled sheet (cold rolling step).

The hot-rolled sheet is preferably pickled for removing scales before cold rolling. The pickling may be performed under ordinary conditions. The cold rolling conditions are not particularly limited as long as the cold-rolled sheet having desired dimensions can be formed. However, the reduction rate of cold rolling is preferably at least 40% or more, and more preferably 50% or more. A high reduction rate of cold rolling is effective in increasing the r value. When the reduction rate is less than 40%, the {111} recrystallized texture is not easily developed, and thus excellent deep drawability is difficult to achieve. On the other hand, the r value is more increased as the reduction rate of cold rolling is increased in a range of up to 90%. However, when the reduction rate exceeds 90%, the effect is saturated, and the load on a roll in cold rolling is increased. Therefore, the upper limit of the reduction rate is preferably 90%.

Next, the cold-rolled sheet is annealed at an annealing temperature of 800° C. to 950° C. and then cooled in a temperature range from the annealing temperature to 500° C. at an average cooling rate of 5° C./s or more (cold-rolled sheet annealing step).

The annealing is preferably continuous annealing to be performed in a continuous annealing line or a continuous hot-dip galvanization line, for securing the cooling rate, and the annealing must be performed in a temperature range from 800° C. to 950° C. The maximum attained temperature of annealing, i.e., the annealing temperature, is set to 800° C. or more, thereby attaining at least a temperature at which a α-γ intercritical region, i.e., a microstructure including a ferrite phase and a martensite phase, can be obtained after cooling, and at least the recrystallization temperature. When the annealing temperature is lower than 800° C., the martensite phase cannot be sufficiently formed after cooling, or recrystallization is not completed to fail to form a texture of a ferrite phase, thereby failing to increase the r value. Therefore, the annealing temperature is 800° C. or more. On the other hand, when the annealing temperature exceeds 950° C., recrystallized grains are significantly coarsened, thereby significantly degrading the characteristics. Therefore, the annealing temperature is 950° C. or less.

Furthermore, when the heating rate of the steel sheet during the annealing, particularly the rate of heating from 300° C. to 700° C., is less than 1° C./s, strain energy tends to be released due to recovery before recrystallization, and consequently the driving force of recrystallization is decreased. Therefore, the average heating rate from 300° C. to 700° C. is preferably 1° C./s or more. The upper limit of the heating rate need not be particularly specified, but, with current equipment, the upper limit of the average heating rate from 300° C. to 700° C. is about 50° C./s. Therefore, the temperature is preferably increased from the 700° C. to the annealing temperature at a heating rate of 0.1° C./s or more from the viewpoint of formation of the recrystallized texture. However, when the temperature is increased from 700° C. to the annealing soaking temperature (annealing ultimate temperature) at 20° C./s or more, transformation from an unrecrystallized portion or transformation of the unrecrystallized portion itself easily proceeds to cause a disadvantage in forming the texture. Thus, the heating rate is preferably 20° C./s or less.

With respect to the cooling rate after the annealing, cooling must be performed in a temperature region from the annealing temperature to 500° C. at an average cooling rate of 5° C./s or more from the viewpoint of formation of the martensite phase. When the average cooling rate in the temperature region is less than 5° C./s, the martensite phase is not easily formed to form a ferrite single-phase microstructure, thereby failing to sufficiently strengthen the microstructure.

The presence of a second phase including a martensite phase is essential, and thus the average rate of cooling to 500° C. must be the critical cooling rate or more. This can be satisfied by an average cooling rate of 5° C./s or more. Cooling to lower than 500° C. is not particularly limited, but the cooling is preferably performed continuously or preferably up to 300° C. at an average cooling rate of 5° C./s or more. When overaging is performed, the average cooling rate is preferably 5° C./s or more up to the overaging temperature.

From the viewpoint of formation of the martensite phase, the upper limit of the cooling rate need not be particularly limited, and roll quench cooling, gas jet cooling, cooling with a water quenching apparatus, or the like may be used.

After the cold-rolled sheet annealing step, a plated layer may be formed on a surface of the steel sheet by surface treatment such as electroplating or hot-dip galvanization.

For example, when hot dip galvanization, which is frequently used for automobile steel sheets, is performed as plating, the annealing may be performed in a continuous hot dip galvanization line so that the steel sheet is dipped in a hot dip galvanization bath in succession to cooling after the annealing to form a galvanized layer on a surface. In this case, the steel sheet removed from the hot dip galvanization bath is preferably cooled to 300° C. at an average cooling rate of 5° C./s or more. After dipping in the hot dip galvanization bath, alloying may be further performed to produce an alloyed, galvannealed steel sheet. In this case, the steel sheet after alloying is preferably cooled to 300° C. at an average cooling rate of 5° C./s or more. In cooling after the hot dip galvanization bath or after the alloying, from the viewpoint of formation of the martensite phase, the upper limit of the cooling rate need not be particularly limited, and roll quench cooling, gas jet cooling, cooling with a water quenching apparatus, or the like may be used.

Alternatively, the steps up to cooling after the annealing may be performed in an annealing line, and then hot-dip galvanization may be performed in a separate hot-dip galvanization line after cooling to room temperature, or alloying may be further performed.

The plated layer is not limited to plated layers formed by pure zinc plating and zinc alloy plating, and, of course, various plated layers conventionally formed on surfaces of steel sheets, such as plated layers formed by Al plating, Al alloy plating, and the like may be formed.

The cold-rolled steel sheet (also referred to as the "cold-rolled annealed sheet") or the plated steel sheet produced as described above may be temper-rolled or leveler-processed for correcting the shape, controlling the surface roughness, or the like. The elongation of temper rolling or leveler processing is preferably in a range of 0.2 to 15% in total. When the elongation is less than 0.2%, possibly, the intended purpose of correcting the shape, controlling surface roughness, or the like cannot be achieved. When the elongation exceeds 15%, the ductility undesirably tends to significantly decrease. It has been confirmed that the temper rolling and leveler processing are different in processing form, but the effects thereof are not so different. The temper rolling and leveler processing are also effective after plating.

EXAMPLES

Examples will be described below.

Melted steel having each of the compositions shown in Table 1 was refined by converter and formed in a slab by a continuous casing method. Each of the steel slabs was heated to 1250° C. and roughly rolled to form a bar, and the bar was finish-rolled in a hot rolling step under the conditions shown in Table 2 to form a hot-rolled sheet. The hot-rolled sheet was pickled and cold-rolled with a reduction rate of 65% in a cold rolling step to form a cold-rolled sheet having a thickness of 1.2 mm. Then, the cold-rolled sheet was continuously annealed in a continuous annealing line under the conditions shown in Table 2. The resultant cold-rolled annealed sheet was temper-rolled with an elongation of 0.5%, followed by evaluation of characteristics. The steel sheets of Nos. 2 and 9 were produced by the cold rolling annealing step in a continuous hot dip galvanization line, hot-dip galvanization (plating bath temperature: 480° C.) in the same line to produce a galvanized steel sheet, and then temper rolling, followed by evaluation of characteristics. FIG. 2(*a*) shows steel sheet No. 25; FIG. 2(*b*), steel sheet No. 26; FIG. 3(*a*), steel sheet No. 27; and FIG. 3(*b*), steel sheet No. 28.

Table 2 shows the results of measurement of the microscopic structure, tensile properties, and r value of each of the resultant cold-rolled annealed sheets and galvanized steel sheets. Also, the hot-rolled sheets after the hot rolling step were examined with respect to the ratio of precipitated and fixed C and the microscopic structure (crystal grain size). The examination methods were as follows:

(i) Ratio of C Precipitated and Fixed as NbC in Hot-Rolled Sheet

As described above, the amounts of precipitated Nb, precipitated Ti, precipitated N, and precipitated S were determined by extraction analysis, and the ratio of precipitated and fixed C was determined by the following equation:

$$[C]_{fix}=100\times12\times([Nb^*]/93)/[C]_{total}$$

When steel does not contain Ti, [Nb*] is the following:

$$[Nb^*]=[Nb]-(93[N]/14),\ [Nb^*]>0$$

When steel contains Ti, [Nb*] is the following:

$$[Nb^*]=[Nb]-(93[N^*]/14)$$

In these equations, $$[N^*]=[N]-(14[Ti^*]/48),\ [N^*]>0$$

$$[Ti^*]=[Ti]-(48[S]/32),\ [Ti^*]>0$$

$[C]_{fix}$: ratio of precipitated and fixed C (%)

$[C]_{total}$: total C content of steel (% by mass)

[Nb], [N], [Ti], and [S] represent the amounts (% by mass) of precipitated Nb, precipitated N, precipitated Ti, and precipitated S, respectively.

In a method of extraction analysis, the residue obtain by electrolytic extraction with a 10% maleic acid electrolyte was fused with an alkali, and then the resultant melt was dissolved in an acid and then quantitatively measured by ICP emission spectroscopy.

(ii) Crystal Grain Size of Hot-Rolled Sheet

After nital corrosion, a section (L section) of the sheet parallel to the rolling direction was imaged with an optical microscope, and the average section length 1 (μm) of crystal grains was determined by the cutting method according to JIS G 0552, as described above. The crystal grain size was denoted by (ASTM) nominal grain size $d_n$=1.13×1. As described above, normal deep corrosion lines and shallow corrosion lines, which occurred by nital corrosion, were counted as grain boundaries. It was confirmed by EBSP analysis that the average crystal grain size measured as described above corresponds to the value measured assuming that crystal grain boundaries with an inclination of 5° or more are regarded as crystal grain boundaries. The nital solution used was a 3% nitric acid-alcohol solution (3% $HNO_3$—$C_2H_5OH$), and corrosion was performed for 10 to 15 seconds.

(iii) Microscopic Structure of Cold-Rolled Annealed Sheet

A test piece was sampled from each of the cold-rolled annealed sheets, and a microscopic structure of a sheet section (L section) of each sample parallel to the rolling direction was imaged with an optical microscope or a scanning electron microscope with a magnification of 400 to 10000. The types of the phases were observed, and the area ratios of a ferrite phase as a main phase and a second phase were determined from an image of 1000 to 3000 magnifications.

(iv) Tensile Properties

A tensile test piece of JIS No. 5 was sampled from each of the resultant cold-rolled annealed sheets in a direction (C direction) at 90° C. with the rolling direction, and a tensile test was carried out at a crosshead speed of 10 mm/min according to the specifications of JIS Z 2241 to determine yield stress (YS), tensile strength (TS), and elongation (E1).

(v) Average r Value

Tensile test pieces of JIS No. 5 were sampled from each of the resultant cold-rolled annealed sheets in the rolling direction (L direction), a direction (D direction) at 45° with the rolling direction, and a direction (C direction) at 90° with the rolling direction. Each of the test pieces was measured with respect to width strain and thickness strain when 10% uniaxial tensile strain was applied. Using these measured values, the average r value (average plastic strain ratio) was calculated from the following equation according to the specifications of JIS Z 2241:

$$\text{Average } r \text{ value}=(r_0+2r_{45}+r_{90})/4$$

wherein $r_0$, $r_{45}$, and $r_{90}$ denote the plastic strain ratios of test pieces sampled at 0°, 45°, and 90°, respectively, with the rolling direction of the sheet plane.

(vi) Texture

Energy dispersive X-ray diffraction was performed using white X-rays at a position at a ¼ thickness of each of the resultant cold-rolled annealed sheets. The measurement planes included a total of 10 planes of (110), (200), (211), (220), (310), (222), (321), (400), (411), and (420) which are principal diffracting planes of α-Fe. The normalized X-ray integrated intensity ratio of each plane was determined as a relative intensity ratio to a nonoriented standard sample. The determined normalized X-ray integrated intensity ratios $P_{(222)}$, $P_{(200)}$, $P_{(110)}$, and $P_{(310)}$ of the respective (222), (200), (110), and (310) planes were substituted into the respective terms on the right side of the following equation to calculate the term A on the left side:

$$A=P_{(222)}/\{P_{(200)}+P_{(110)}+P_{(310)}\}$$

The measurement results shown in Table 2 indicate that in all examples, TS is 440 MPa or more, the average r values are 1.2 or more, and thus deep drawability is excellent. On the other hand, the steel sheets of comparative examples produced under conditions out of our range have low strength or r values of less than 1.2, and thus exhibit low deep drawability.

INDUSTRIAL APPLICABILITY

A high-strength steel sheet having an average r value of 1.2 or more and excellent drawability can be stably produced at low cost even when strength TS is 440 MPa or more or when the strength TS is 500 MPa or 590 MPa or more. Therefore, an industrially significant effect can be exhibited. For example, when a high-strength steel sheet is applied to an automobile part, the strength of a portion, which has have difficulty in press forming so far, can be increased, thereby causing the effect of sufficiently contributing to safety at the time of crash and weight lightening of vehicles bodies. The steel sheet can also be applied household electric appliances and pipe materials as well as automobile parts.

TABLE 1

| Steel No. | Chemical Composition (% by mass) | | | | | | | | | | | | | | | |
|---|---|---|---|---|---|---|---|---|---|---|---|---|---|---|---|---|
| | C | Si | Mn | P | S | Al | Nb | N | Mo | Cr | Cu | Ni | Ti | *1 | *2 | Remarks |
| A | 0.014 | 0.09 | 1.52 | 0.022 | 0.005 | 0.034 | 0.034 | 0.0016 | 0.148 | — | — | — | — | 0.31 | — | Adaptive Example |
| B | 0.020 | 0.31 | 1.60 | 0.052 | 0.002 | 0.035 | 0.062 | 0.0020 | — | — | — | — | 0.012 | 0.40 | 1.2 | Adaptive Example |
| C | 0.023 | 0.52 | 1.85 | 0.041 | 0.003 | 0.033 | 0.065 | 0.0018 | — | — | — | — | — | 0.36 | — | Adaptive Example |
| D | 0.025 | 0.28 | 2.01 | 0.038 | 0.005 | 0.035 | 0.082 | 0.0015 | 0.152 | — | — | — | 0.015 | 0.42 | 1.2 | Adaptive Example |
| E | 0.026 | 0.51 | 2.11 | 0.035 | 0.004 | 0.033 | 0.078 | 0.0022 | 0.145 | — | — | — | 0.011 | 0.39 | 0.8 | Adaptive Example |
| F | 0.022 | 0.69 | 2.22 | 0.054 | 0.005 | 0.033 | 0.075 | 0.0021 | 0.150 | — | — | — | — | 0.44 | — | Adaptive Example |
| G | 0.028 | 0.50 | 1.98 | 0.033 | 0.003 | 0.045 | 0.080 | 0.0025 | 0.141 | 0.25 | — | — | 0.022 | 0.37 | 1.7 | Adaptive Example |
| H | 0.030 | 0.42 | 2.10 | 0.035 | 0.002 | 0.029 | 0.116 | 0.0026 | 0.072 | — | — | — | 0.016 | 0.50 | 1.3 | Adaptive Example |
| I | 0.031 | 0.48 | 2.05 | 0.035 | 0.003 | 0.033 | 0.075 | 0.0028 | — | — | 0.30 | 0.15 | 0.022 | 0.31 | 1.6 | Adaptive Example |
| J | 0.035 | 0.01 | 2.22 | 0.035 | 0.004 | 0.038 | 0.078 | 0.0025 | — | 0.22 | — | — | 0.028 | 0.29 | 1.9 | Adaptive Example |
| K | 0.037 | 0.18 | 2.10 | 0.035 | 0.004 | 0.105 | 0.075 | 0.0025 | 0.150 | — | — | — | — | 0.26 | — | Adaptive Example |
| L | 0.040 | 0.20 | 2.10 | 0.030 | 0.003 | 0.051 | 0.082 | 0.0025 | — | — | — | — | 0.025 | 0.26 | 1.9 | Adaptive Example |
| M | 0.046 | 0.23 | 1.52 | 0.012 | 0.003 | 0.038 | 0.235 | 0.0021 | — | — | — | — | 0.015 | 0.66 | 1.3 | Adaptive Example |
| N | 0.006 | 0.51 | 2.30 | 0.045 | 0.005 | 0.035 | 0.010 | 0.0019 | — | — | — | — | — | 0.22 | — | Comp. Example |
| O | 0.080 | 0.01 | 1.32 | 0.050 | 0.003 | 0.033 | 0.013 | 0.0045 | — | — | — | — | — | 0.02 | — | Comp. Example |
| P | 0.050 | 0.01 | 1.77 | 0.035 | 0.003 | 0.047 | — | 0.0023 | 0.120 | — | — | — | — | 0 | — | Comp. Example |
| Q | 0.015 | 0.50 | 2.04 | 0.048 | 0.006 | 0.032 | 0.165 | 0.0023 | — | — | — | — | — | 1.42 | — | Comp. Example |
| R | 0.033 | 0.02 | 2.05 | 0.037 | 0.005 | 0.035 | — | 0.0020 | — | — | — | — | — | — | — | Comp. Example |
| S | 0.035 | 0.05 | 2.04 | 0.035 | 0.005 | 0.033 | 0.015 | 0.0016 | — | — | — | — | — | 0.06 | — | Comp. Example |
| T | 0.035 | 0.03 | 2.00 | 0.037 | 0.004 | 0.030 | 0.083 | 0.0024 | — | — | — | — | — | 0.31 | — | Adaptive Example |
| U | 0.035 | 0.01 | 2.10 | 0.035 | 0.004 | 0.031 | 0.072 | 0.0024 | — | — | — | — | — | 0.27 | — | Adaptive Example |
| V | 0.032 | 0.15 | 1.90 | 0.035 | 0.005 | 0.027 | 0.075 | 0.0018 | — | — | — | — | 0.02 | 0.30 | 1.5 | Adaptive Example |
| W | 0.018 | 0.05 | 1.55 | 0.025 | 0.005 | 0.035 | 0.050 | 0.0020 | — | — | — | — | — | 0.36 | — | Adaptive Example |
| X | 0.018 | 0.08 | 1.50 | 0.035 | 0.005 | 0.035 | 0.050 | 0.0025 | — | — | — | — | 0.023 | 0.36 | 1.4 | Adaptive Example |
| Y | 0.018 | 0.05 | 1.52 | 0.035 | 0.005 | 0.035 | 0.050 | 0.0025 | 0.15 | — | — | — | 0.020 | 0.36 | 1.2 | Adaptive Example |
| Z | 0.024 | 0.35 | 1.80 | 0.038 | 0.005 | 0.038 | 0.065 | 0.0023 | 0.10 | 0.10 | — | — | 0.025 | 0.35 | 1.6 | Adaptive Example |
| AA | 0.030 | 0.50 | 2.10 | 0.035 | 0.005 | 0.035 | 0.082 | 0.0020 | — | — | — | — | — | 0.35 | — | Adaptive Example |
| AB | 0.035 | 0.08 | 2.05 | 0.037 | 0.005 | 0.037 | 0.058 | 0.0020 | — | — | — | — | — | 0.21 | — | Adaptive Example |
| AC | 0.035 | 0.10 | 2.08 | 0.037 | 0.005 | 0.038 | 0.182 | 0.0024 | — | — | — | — | — | 0.67 | — | Adaptive Example |
| AD | 0.018 | 0.08 | 0.70 | 0.025 | 0.006 | 0.032 | 0.052 | 0.0022 | — | — | — | — | — | 0.37 | — | Comp. Example |
| AE | 0.020 | 0.10 | 1.65 | 0.032 | 0.006 | 0.033 | 0.140 | 0.0025 | — | — | — | — | — | 0.90 | — | Comp. Example |

(Note)

*1 = (Nb/93)/(C/12)

*2 = (Ti/48)/{(S/32) + (N/41)}

TABLE 2

| Steel sheet No. | Steel No. | FT (° C.) | CT (° C.) | $C_{fix}$ (%) | dn (μm) | Average heating rate from 300° C. to 700° C. (° C./s) | Average heating rate from 700° C. to annealing temperature (° C./s) | Annealing temperature (° C.) | Average cooling rate from annealing temperature to 500° C. (° C./s) | Average cooling rate from 500° C. or after plating to 300° C. (° C./s) | Microstructure of steel: Area ratio of ferrite phase (%) | Microstructure of steel: Area ratio of martensite phase (%) | Microstructure of steel: Area ratio of other phase (%) |
|---|---|---|---|---|---|---|---|---|---|---|---|---|---|
| 1 | A | 870 | 600 | 24 | 6.4 | 15 | 0.5 | 850 | 20 | 20 | 95 | 5 | — |
| 2 | | 870 | 600 | 24 | 6.4 | 15 | 0.5 | 850 | 20 | 20 | 94 | 4 | B |
| 3 | | 870 | 600 | 24 | 6.4 | 15 | 0.5 | 850 | 3 | 20 | 85 | 0 | P |
| 4 | B | 870 | 650 | 36 | 6.1 | 8 | 1.0 | 850 | 20 | 20 | 93 | 7 | — |
| 5 | | 870 | 650 | 36 | 6.1 | 8 | — | 700 | 20 | 20 | 100 | 0 | — |
| 6 | C | 870 | 650 | 28 | 6.2 | 5 | 2.0 | 850 | 20 | 20 | 91 | 9 | — |
| 7 | | 870 | 750 | 15 | 9.2 | 5 | 2.0 | 850 | 20 | 20 | 93 | 2 | P, B |
| 8 | D | 860 | 600 | 37 | 5.2 | 12 | 1.5 | 860 | 15 | 15 | 92 | 8 | — |
| 9 | | 860 | 600 | 37 | 5.2 | 12 | 1.5 | 860 | 15 | 15 | 91 | 8 | B |
| 10 | E | 860 | 600 | 32 | 5.3 | 12 | 1.5 | 870 | 15 | 15 | 90 | 10 | — |
| 11 | | 860 | 300 | 10 | 8.3 | 12 | 1.5 | 870 | 15 | 15 | 76 | 8 | P |
| 12 | F | 870 | 600 | 37 | 5.8 | 12 | 1.5 | 850 | 20 | 20 | 90 | 5 | B, γ' |
| 13 | G | 860 | 630 | 28 | 3.1 | 12 | 1.5 | 840 | 10 | 15 | 93 | 5 | B |
| 14 | H | 870 | 600 | 41 | 5.0 | 12 | 1.5 | 870 | 20 | 20 | 89 | 11 | — |
| 15 | I | 870 | 620 | 23 | 4.2 | 12 | 1.5 | 850 | 10 | 15 | 90 | 7 | B |
| 16 | J | 860 | 610 | 23 | 2.9 | 12 | 1.5 | 840 | 5 | 15 | 93 | 7 | — |
| 17 | K | 860 | 630 | 21 | 3.5 | 12 | 1.5 | 850 | 8 | 15 | 89 | 10 | B |
| 18 | L | 860 | 610 | 21 | 3.6 | 12 | 3.0 | 830 | 8 | 15 | 90 | 8 | B |
| 19 | M | 860 | 650 | 48 | 5.2 | 12 | 1.5 | 830 | 20 | 20 | 82 | 15 | B |
| 20 | | 860 | 650 | 48 | 5.2 | 12 | 1.5 | 980 | 20 | 20 | 0 | 90 | B |
| 21 | N | 850 | 650 | 10 | 23.0 | 12 | 1.5 | 880 | 20 | 20 | 97 | 0 | P |
| 22 | O | 860 | 550 | 1 | 15.0 | 12 | 1.5 | 820 | 20 | 20 | 78 | 12 | B |
| 23 | P | 870 | 650 | 0 | 12.0 | 12 | 1.5 | 820 | 20 | 20 | 85 | 15 | — |
| 24 | Q | 860 | 600 | 65 | 6.0 | 12 | 1.5 | 830 | 20 | 20 | 100 | 0 | — |
| 25 | R | 880 | 650 | — | 8.9 | 12 | 1.6 | 850 | 17 | 20 | 92 | 8 | — |
| 26 | S | 880 | 600 | 4 | 5.9 | 12 | 1.6 | 850 | 17 | 20 | 94 | 6 | — |
| 27 | T | 880 | 650 | 28 | 5.6 | 12 | 1.6 | 850 | 17 | 20 | 93 | 7 | — |
| 28 | U | 860 | 610 | 25 | 2.8 | 12 | 1.6 | 850 | 17 | 20 | 90 | 10 | — |
| 29 | V | 860 | 620 | 25 | 3.2 | 12 | 1.0 | 850 | 20 | 20 | 91 | 9 | — |
| 30 | W | 880 | 600 | 28 | 6.1 | 15 | 0.5 | 860 | 20 | 20 | 93 | 7 | — |
| 31 | X | 880 | 600 | 26 | 5.9 | 15 | 0.5 | 860 | 20 | 20 | 94 | 6 | — |
| 32 | Y | 880 | 600 | 24 | 5.8 | 15 | 0.5 | 860 | 20 | 20 | 95 | 5 | — |
| 33 | Z | 870 | 650 | 28 | 5.7 | 10 | 2.0 | 850 | 17 | 15 | 94 | 6 | — |
| 34 | AA | 860 | 620 | 27 | 4.3 | 12 | 1.5 | 850 | 15 | 15 | 91 | 9 | — |
| 35 | AB | 860 | 610 | 17 | 4.9 | 12 | 1.5 | 850 | 8 | 15 | 88 | 12 | — |
| 36 | AC | 860 | 610 | 53 | 3.0 | 12 | 1.5 | 850 | 8 | 15 | 94 | 6 | — |
| 37 | AD | 880 | 600 | 30 | 6.2 | 15 | 0.5 | 860 | 5 | 5 | 97 | 0 | P |
| 38 | AE | 870 | 650 | 78 | 3.8 | 8 | 1.0 | 850 | 20 | 20 | 100 | 0 | — |

| Steel sheet No. | Mechanical properties: YS (MPa) | TS (MPa) | El (%) | Average r value | Texture A value | Plating | Remarks |
|---|---|---|---|---|---|---|---|
| 1 | 280 | 445 | 39 | 2.0 | 8.8 | — | Example of this invention |
| 2 | 290 | 455 | 38 | 1.8 | 7.4 | present | Example of this invention |
| 3 | 360 | 380 | 35 | 1.5 | 4.8 | — | Comparative Example |
| 4 | 350 | 515 | 35 | | 7.2 | — | Example of this invention |
| 5 | 390 | 430 | 38 | 0.8 | 0.9 | — | Comparative Example |
| 6 | 370 | 550 | 31 | 1.5 | 5.2 | — | Example of this invention |
| 7 | 480 | 500 | 33 | 1.0 | 1.3 | — | Comparative Example |
| 8 | 390 | 615 | 30 | 1.3 | 3.3 | — | Example of this invention |
| 9 | 410 | 625 | 28 | 1.3 | 3.1 | present | Example of this invention |
| 10 | 410 | 620 | 30 | 1.3 | 2.9 | — | Example of this invention |
| 11 | 365 | 550 | 28 | 0.7 | 1.0 | — | Comparative Example |
| 12 | 450 | 635 | 32 | 1.4 | 3.8 | — | Example of this invention |

TABLE 2-continued

| | | | | | | | |
|---|---|---|---|---|---|---|---|
| 13 | 390 | 610 | 32 | 1.4 | 4.1 | — | Example of this invention |
| 14 | 380 | 650 | 29 | 1.2 | 2.6 | — | Example of this invention |
| 15 | 415 | 640 | 29 | 1.4 | 4.2 | — | Example of this invention |
| 16 | 425 | 645 | 29 | 1.4 | 3.6 | — | Example of this invention |
| 17 | 420 | 640 | 30 | 1.4 | 2.8 | — | Example of this invention |
| 18 | 410 | 625 | 30 | 1.3 | 2.9 | — | Example of this invention |
| 19 | 420 | 680 | 26 | 1.2 | 2.6 | — | Example of this invention |
| 20 | 680 | 750 | 19 | 0.7 | 0.9 | — | Comparative Example |
| 21 | 350 | 420 | 38 | 1.5 | 3.0 | — | Comparative Example |
| 22 | 440 | 570 | 25 | 0.8 | 1.2 | — | Comparative Example |
| 23 | 405 | 660 | 22 | 0.8 | 0.8 | — | Comparative Example |
| 24 | 380 | 400 | 33 | 1.8 | 7.5 | — | Comparative Example |
| 25 | 405 | 620 | 30 | 0.9 | 0.9 | — | Comparative Example |
| 26 | 405 | 615 | 29 | 1.0 | 1.2 | — | Comparative Example |
| 27 | 405 | 630 | 30 | 1.3 | 3.2 | — | Example of this invention |
| 28 | 390 | 630 | 31 | 1.5 | 4.2 | — | Example of this invention |
| 29 | 415 | 630 | 32 | 1.5 | 4.1 | — | Example of this invention |
| 30 | 295 | 460 | 40 | 2.0 | 8.7 | — | Example of this invention |
| 31 | 290 | 455 | 38 | 2.1 | 8.9 | — | Example of this invention |
| 32 | 305 | 470 | 37 | 2.1 | 8.8 | — | Example of this invention |
| 33 | 380 | 570 | 31 | 1.5 | 5.5 | — | Example of this invention |
| 34 | 400 | 625 | 29 | 1.4 | 3.7 | — | Example of this invention |
| 35 | 410 | 660 | 28 | 1.3 | 2.7 | — | Example of this invention |
| 36 | 370 | 550 | 30 | 1.5 | 5.4 | — | Example of this invention |
| 37 | 300 | 425 | 36 | 1.7 | 7.0 | — | Comparative Example |
| 38 | 310 | 430 | 35 | 1.8 | 7.1 | — | Comparative Example |

FT: finisher delivery temperature
CT: coiling temperature
$C_{fix}$: amount of C precipitated and fixed as NbC in the hot-rolled sheet
$d_n$: average crystal grain size of the hot-rolled sheet, including small angle/inclination grain boundaries with an inclination of less than 15° C. (nominal grain size)
P: pearlite phase
B: bainite phase
γ': residual austenite phase
A value: $P_{(222)}/\{P_{(200)} + P_{(110)} + P_{(310)}\}$

The invention claimed is:

1. A high-strength steel sheet having excellent deep drawability, an average r value of 1.2 or more, and a composition, which is free of V, comprising by % by mass:

C: about 0.010 to about 0.050%;

Si: about 1.0% or less;

Mn: about 1.0 to about 3.0%;

P: about 0.005 to about 0.1%;

S: about 0.01% or less;

Al: about 0.005 to about 0.5%;

N: about 0.01% or less;

Nb: about 0.01 to about 0.3%; and the balance substantially including Fe and inevitable impurities, the Nb and C contents in steel satisfying the relation, (Nb/93)/(C/12)=0.2 to less than 0.5 (wherein Nb and C represent the contents (% by mass) of the respective elements) and C in solution is, 47 to 83% of total C content and the steel microstructure containing a ferrite phase and a martensite phase at area ratios of about 50% or more and about 1% or more, respectively, and having a grain size of 8 μm or less.

2. The high-strength steel sheet having excellent deep drawability according to claim 1, wherein the steel sheet satisfies the following relation between normalized X-ray integrated intensity ratios of (222) plane, (200) plane, (110)

plane, and (310) plane parallel to the sheet plane at a ¼ thickness of the steel sheet:

P(222)/{P(200)+P(110)+P(310)} 1.5 (wherein P(222), P(200), P(110), and P(310) are the normalized X-ray integrated intensity ratios of the (222) plane, (200) plane, (110) plane, and (310) plane, respectively, parallel to the sheet plane at a ¼ thickness of the steel sheet).

3. The high-strength steel sheet having excellent deep drawability according to claim 1, further comprising at least one of Mo, Cr, Cu, and Ni in a total of about 0.5% by mass or less in addition to the composition.

4. The high-strength steel sheet having excellent deep drawability according to claim 1, further comprising about 0.1% by mass or less of Ti in addition to the composition, the contents of Ti, S, and N satisfying the following relation:

$$(Ti/48)/\{(S/32)+(N/14)\} \leqq 2.0$$

(wherein Ti, S, and N represents the contents (% by mass) of the respective elements).

5. The high-strength steel sheet having excellent deep drawability according to claim 1, further comprising a plated layer on a surface thereof.

6. A process for producing a high-strength steel sheet having excellent deep drawability, the process comprising a hot rolling step of finish-rolling a steel slab by hot rolling at a finisher delivery temperature of about 800° C. or more to form a hot-rolled sheet having a grain size of 8 μm or less and coiling the hot-rolled sheet at a coiling temperature of about 400 to about 720° C., a cold rolling step of cold-rolling the hot-rolled sheet to form a cold-rolled sheet, and a cold-rolled sheet annealing step of annealing the cold-rolled sheet at an annealing temperature of about 800 to about 950° C. and then cooling the annealed sheet in a temperature range from the annealing temperature to about 500° C., at an average cooling rate of about 5° C./s or more, the steel slab having a composition, which is free of V, comprising by % by mass:

C: about 0.010 to about 0.050%;
Si: about 1.0% or less;
Mn: about 1.0 to about 3.0%;
P: about 0.005 to about 0.1%;
S: about 0.001% or less;
Al: about 0.005 to about 0.5%;
N: about 0.01% or less; and
Nb: about 0.01 to about 0.3%;

the Nb and C contents in steel satisfying the relation, (Nb/93)/(C/12)=0.2 to less than 0.5 (wherein Nb and C represent the contents (% by mass) of the respective elements) and C in solution is 47 to 83% of total C content.

7. A process for producing a high-strength steel sheet having excellent deep drawability, the process comprising a hot rolling step of hot-rolling a steel slab to form a hot-rolled sheet having an average crystal grain size of 8 μm or less, a cold rolling step of cold-rolling the hot-rolled sheet to form a cold-rolled sheet, and a cold-rolled sheet annealing step of annealing the cold-rolled sheet at an annealing temperature of about 800 to about 950° C. and then cooling the annealed sheet in a temperature range from the annealing temperature to about 500° C. at an average cooling rate of about 5° C./s or more, the steel slab having a composition, which is free of V, comprising by % by mass:

C: about 0.010 to about 0.050%;
Si: about 1.0% or less;
Mn: about 1.0 to about 3.0%;
P: about 0.005 to about 0.1%;
S: about 0.01% or less;
Al: about 0.005 to about 0.5%;
N: about 0.01% or less; and
Nb: about 0.01 to about 0.3%;

the Nb and C contents in steel satisfying the relation, (Nb/93)/(C/12)=0.2 to less than 0.5 (wherein Nb and C represent the contents (% by mass) of the respective elements) and C in solution is 47 to 83% of total C content.

8. The process for producing the high-strength steel sheet having excellent deep drawability according to claim 6 or 7, wherein the steel slab further contains at least one of Mo, Cr, Cu, and Ni at a total of about 0.5% by mass or less in addition to the composition.

9. The process for producing the high-strength steel sheet having excellent deep drawability according to claim 6, wherein the steel slab further contains about 0.1% by mass or less of Ti in addition to the composition, the contents of Ti, S, and N satisfying the following relation:

$$(Ti/48)/\{(S/32)+(N/14)\} \leqq 2.0$$

(wherein Ti, S, and N represents the contents (% by mass) of the respective elements).

10. The process for producing the high-strength steel sheet having excellent deep drawability according to claim 6, further comprising a plating step of forming a plated layer on a surface of the steel sheet after the cold-rolled sheet annealing step.

11. The high-strength steel sheet having excellent deep drawability according to claim 2, further comprising at least one of Mo, Cr, Cu, and Ni in a total of about 0.5% by mass or less in addition to the composition.

12. The high-strength steel sheet having excellent deep drawability according to claim 2, further comprising about 0.1% by mass or less of Ti in addition to the composition, the contents of Ti, S, and N satisfying the following relation:

$$(Ti/48)/\{(S/32)+(N/14)\} \leqq 2.0$$

(wherein Ti, S, and N represents the contents (% by mass) of the respective elements).

13. The high-strength steel sheet having excellent deep drawability according to claim 3, further comprising about 0.1% by mass or less of Ti in addition to the composition, the contents of Ti, S, and N satisfying the following relation:

$$(Ti/48)/\{(S/32)+(N/14)\} \leqq 2.0$$

(wherein Ti, S, and N represents the contents (% by mass) of the respective elements).

14. The high-strength steel sheet having excellent deep drawability according to claim 2, further comprising a plated layer on a surface thereof.

15. The high-strength steel sheet having excellent deep drawability according to claim 3, further comprising a plated layer on a surface thereof.

16. The high-strength steel sheet having excellent deep drawability according to claim 4, further comprising a plated layer on a surface thereof.

17. The process for producing the high-strength steel sheet having excellent deep drawability according to claim 7, further comprising a plating step of forming a plated layer on a surface of the steel sheet after the cold-rolled sheet annealing step.

18. The process for producing the high-strength steel sheet having excellent deep drawability according to claim 8, further comprising a plating step of forming a plated layer on a surface of the steel sheet after the cold-rolled sheet annealing step.

19. The process for producing the high-strength steel sheet having excellent deep drawability according to claim 9, further comprising a plating step of forming a plated layer on a surface of the steel sheet after the cold-rolled sheet annealing step.

* * * * *